US007905323B2

(12) United States Patent
Larsen

(10) Patent No.: US 7,905,323 B2
(45) Date of Patent: Mar. 15, 2011

(54) METHOD, DEVICE AND SYSTEM FOR ALTERING THE REVERBERATION TIME OF A ROOM

(76) Inventor: Niels Werner Larsen, Copenhagen V (DK)

( * ) Notice: Subject to any disclaimer, the term of this patent is extended or adjusted under 35 U.S.C. 154(b) by 116 days.

(21) Appl. No.: 10/587,898

(22) PCT Filed: Aug. 2, 2005

(86) PCT No.: PCT/IB2005/052580

§ 371 (c)(1),
(2), (4) Date: Jul. 28, 2006

(87) PCT Pub. No.: WO2006/016321

PCT Pub. Date: Feb. 16, 2006

(65) Prior Publication Data

US 2007/0140518 A1 Jun. 21, 2007

(30) Foreign Application Priority Data

Aug. 6, 2004 (DK) ..... 2004 01199
May 13, 2005 (WO) ..... PCT/DK2005/000322

(51) Int. Cl.
*E04B 1/99* (2006.01)

(52) U.S. Cl. ..... 181/287; 181/30; 181/286

(58) Field of Classification Search ..... 181/30, 181/286, 287, 288, 293, 294, 295, 296
See application file for complete search history.

(56) References Cited

U.S. PATENT DOCUMENTS

| | | | | |
|---|---|---|---|---|
| 5,299,522 | A | 4/1994 | Dixon et al. | |
| 5,394,786 | A * | 3/1995 | Gettle et al. | 86/50 |
| 5,901,769 | A * | 5/1999 | Farley | 160/123 |
| 6,282,842 | B1 * | 9/2001 | Simens | 52/2.11 |
| 6,332,027 | B1 | 12/2001 | Guilloud et al. | |
| 6,567,341 | B2 * | 5/2003 | Dreyer et al. | 367/1 |
| 6,802,386 | B2 * | 10/2004 | Koelle | 181/224 |
| 2003/0041378 | A1 * | 3/2003 | Davis | 5/615 |
| 2004/0074151 | A1 | 4/2004 | Morris | |

FOREIGN PATENT DOCUMENTS

| | | |
|---|---|---|
| FR | 2 615 549 | 11/1988 |
| WO | WO 2004/010663 | 12/2004 |

* cited by examiner

*Primary Examiner* — Elvin G Enad
*Assistant Examiner* — Jeremy Luks
(74) *Attorney, Agent, or Firm* — Stites & Harbison PLLC; Douglas E. Jackson

(57) ABSTRACT

The invention relates to sound-absorbing devices, assemblies and systems and corresponding methods for altering the reverberation time of a room, specifically although not necessarily exclusively at low frequencies. A sound-absorbing device according to the invention comprises basically a body containing one or more cavities (4), where at least a portion of the outer surface of the body is in contact with said sound field S and where said body is inflatable/extendable and collapsible/compressible during the supply of a gas to or the removal of the gas from said at least one cavity (4), respectively, whereby the absorption coefficient (a) and/or the resonance frequency of said body can be varied, thus determining the absorption coefficient and/or the frequency region in which maximum absorption will take place.

31 Claims, 15 Drawing Sheets

METHOD, DEVICE AND SYSTEM FOR ALTERING THE REVERBERATION TIME OF A ROOM

TECHNICAL FIELD

The present invention relates to a method for altering the reverberation time of a room and particularly to a method for altering the reverberation time of a room in the low-frequency range. The present invention furthermore relates to sound-absorbing devices and systems of such devices used for said altering of the reverberation time of a room. The present invention furthermore relates to a room provided with such devices and/or systems, whereby the reverberation time of the room can be altered.

BACKGROUND OF THE INVENTION

It is well known within the art that one of the acoustic parameters that affects the perceived sound quality in a listening room, for instance a concert hall or auditorium, is the reverberation time of the room. However, the optimal reverberation time differs for various kinds of music and for speech, recommended reverberation times for rooms in which classical music is to be performed thus being in the range of 1.5 seconds to 2.0 seconds, whereas rooms for performance of rhythmic music have recommended reverberation times in the range of 0.8 seconds to 1.0 seconds. Even shorter reverberation times may be beneficial for auditoriums in order to attain the best possible speech intelligibility. Furthermore, the reverberation time should ideally be almost the same throughout the relevant frequency range of the program material. Typically, however, the reverberation time tends to decrease as a function of frequency, e.g. due to higher sound absorption in air at high frequencies, increased sound absorption at the boundaries of the room at higher frequencies as well as due to the presence of people in the room. Thus, low-frequency reverberation often tends to be too high compared with high-frequency reverberation, which may lead to an unacceptably "boomy" reproduction of sounds in the room, a loss of perceived details of the music and even to a deterioration of speech intelligibility. FIG. 1 shows measured reverberation time as a function of frequency of seven different rooms that may be used for live performances or reproduction of music. The figure shows an average reverberation time T30 above 500 Hz of approximately 1 second, whereas the average at low frequencies increases to approximately 1.5 seconds at 63 Hz. It also appears from FIG. 1 that large variations of reverberation time exist between the different rooms.

In view of the above there often exists a need for means for altering the reverberation time of a given room in a desired manner, and especially at low frequencies a selective reduction of reverberation time would be beneficial.

Devices for altering the reverberation time of a listening room are known within the art. Some of these are predominantly effective at higher frequencies, where the reverberation time may be reduced simply by providing thin layers of an acoustic absorptive material—a thin layer of mineral wool covered by a protective screen for instance—on chosen boundaries of the room. Selective reduction of reverberation time at low frequencies is somewhat more difficult to implement, although a number of actual implementations have been successfully applied for many years. Three different implementations of reduction of reverberation time at low frequencies—which to some extent also functions at higher frequencies—should be mentioned:

1. A sufficiently thick panel of an acoustic absorptive (porous) material will lead to sound absorption at low frequencies (as well as at higher frequencies) provided the thickness of the panel is sufficiently large compared with the wavelength of the sound at the lowest frequency at which an effective reduction of reverberation time is required. Example of materials applicable for such panels are glass fibre, mineral wool and sintered metals. Such panels may be mounted directly on a boundary or separated from the boundary by an air space, which will improve performance at low frequencies. The panels may also be hung from the ceiling thus giving access to the panel from both sides. Apart from the required thickness, which may exceed one meter if significant low-frequency absorption of acoustic energy is to be expected, such panels will not selectively absorb sound at low frequencies but rather exhibit a sound absorption as a function of frequency which will be fairly constant above a given lower limiting frequency—determined among other things by the thickness of the panel and the acoustic properties of the particular material being used—and decrease below this lower limiting frequency, thus not being able to provide selective low-frequency reduction of reverberation time as often required.
2. Low-frequency sound absorption can be attained within a limited bandwidth of for instance one octave around a given resonance frequency by the application of so-called panel absorbers or membrane absorbers, basically consisting of a rigid frame adapted for mounting on a wall or other boundary of a room. Over the frame and at a given distance from said wall or boundary there is provided a thin, flexible panel for instance of plywood, which is brought to vibrate driven by the sound field in the room. The mass and stiffness of the panel together with the compliance of the air volume defined by the frame, the panel and the boundary behind the panel will determine the resonance frequency of the absorber and the internal losses will determine the Q value of the resonator and hence its bandwidth. In order to increase absorption as well as to change the Q value of the absorber, acoustic damping material such as mineral wool may be introduced into the cavity within the frame. As the compliance of the air in the cavity depends on the volume of air in the absorber, the resonance frequency may be changed by changing the depth of the resonator and maintaining the circumferential dimensions of the frame. A deeper absorber thus provides a lower resonance frequency. A more rigorous description of these mechanisms will be given in the summary of the present invention
3. Low-frequency sound absorption can furthermore be attained using a so-called Helmholz resonator basically consisting of one or more passages or tubes of a given length and cross sectional area, these one or more passages representing an acoustic mass, where one longitudinal end of one or more passages is/are coupled to the sound field in the room and the other end is coupled to a cavity of a given volume representing an acoustic compliance essentially proportional with the volume of the cavity. The particular combination of mass and compliance determines the resonance frequency of the Helmholz resonator and the internal losses determine the Q value or effective bandwidth of the Helmholz resonator. At and around the resonance frequency, the input impedance of the resonator will be very low and the resonator will hence absorb sound energy from the surrounding sound field selectively in a frequency region around the resonance frequency. As in the case of the panel absorber, damping material such as mineral wool may be introduced in the Helmholz resonator to alter the Q value hereof. In practice Helmholz resonators are often of a form somewhat resembling the above mentioned panel resonators, where the thin, flexible panel have been replaced by a thicker, rigid panel provided with a pattern of passages through the panel. However, Helmholz resonators comprising a single passage or tube and a cavity have also been used for changing the reverberation time and/or suppression of undesired low-frequency room modes.

Background Theory of Membrane Absorbers

A membrane absorber typically consists of a light plate in front of a closed cavity. Often the cavity is filled with a porous material, which provides damping for the system. When deriving the theoretical characteristic equations for a membrane absorber, the walls and back of the cavity are assumed to be rigid and the bending stiffness in the plate is assumed to be negligible compared to the stiffness of the air column in the cavity. The system is characterized by the mass per unit area of the plate, m, the depth of the cavity, d, and the internal losses of the system, $r_i$, consisting of the losses due to the flow resistance of the porous material, internal losses in the plate and losses in the joints along the edges of the plate, ρ is the density of air or other gas in the cavity and c is the speed of sound.

The acoustic impedance of the system can be shown to be:

$$Z = r_i + j\left(\omega m - \frac{\rho c^2}{\omega d}\right)$$

The resonance frequency of the system is found when Im{Z}=0:

$$f_0 = \frac{c}{2\pi}\sqrt{\frac{\rho}{md}}$$

This shows that the resonance frequency, where the absorption should be highest, is inversely proportional to the square root of both the mass of the membrane and the depth of the cavity. According to this theory, in order to obtain a maximum absorption at around 63 Hz, with a cavity depth of 0.2 m, the membrane must have a mass of about 5 kg/m$^2$. But by pressurizing the cavity, the stiffness of the system grows and it may be possible to apply a less heavy material.

The impedance of the absorber can be tuned in order to maximize the absorption at the resonance frequency and the usable bandwidth of the absorber (half-power bandwidth, $B_r$). If the impedance is too high, relative to the radiation resistance of the membrane, $r_s$, the incident sound field will reflect off of the membrane and not be absorbed. If the impedance is too low, then the internal losses will be too small and not enough sound energy will be absorbed. The impedance ratio of the internal losses and the external radiation resistance can be expressed as:

$$\mu = \frac{r_i}{r_s}$$

The maximum absorption coefficient and absorption bandwidth can then be written as:

$$\alpha_{max} = \frac{4\mu}{(1+\mu)^2}$$

$$\frac{B_r}{f_0} = (1+\mu)\sqrt{\frac{\rho d}{m}}$$

Above it has been assumed that the absorbing device be of substantially the same depth d throughout the device. For many of the embodiments of the present invention described in the detailed description of the invention this will not be true, the depth d changing in a characteristic and predetermined manner over the surface of the absorbing device. In such embodiments it may still be possible to apply the above expressions to determine at least approximate values of resonance frequency, absorption coefficient and absorption bandwidth by insertion of an average value of the depth d of the device. Alternatively, the above expressions may be reformulated in terms of the actual air or gas volumes and the corresponding compliances as is known within the field of acoustics.

Measurement of Reverberation and Absorption Coefficients

The absorption coefficients of the test specimen can be calculated from the measured reverberation time of the empty reverberation chamber and the reverberation chamber with test specimen present as follows:

$$\alpha = \frac{55.3V}{cS_S}\left(\frac{1}{T_{60}^S} - \frac{1}{T_{60}}\right)$$

where V is the volume of the reverberation chamber, $S_S$ is the area of the test specimen, $T_{60}^S$ is the reverberation time in the chamber with the specimen present and $T_{60}$ is the reverberation time of the empty chamber.

The above prior art absorbers may attain very high absorption coefficients at and in the vicinity of the resonance frequency and absorption coefficients in the order of 0.9 may well be attained with such absorbers. Nevertheless such prior art absorbers suffer from a number of disadvantages, some of which are described in the following.

The sound absorption characteristics of the above prior art absorbers can not readily be altered once the absorber has been constructed. Specifically major changes of the absorption coefficient α and/or the resonance frequency can not be accomplished by minor modifications of a given absorber. Also the absorption coefficient can not be changed systematically in a simple manner, such changes comprising for instance a shift between a very high absorption coefficient and a very low absorption coefficient, i.e. essentially an on/off function of the absorber.

The above-mentioned absorbers are rather bulky structures that will be difficult—or occasionally even impossible—to remove from a given room once installed. They are to be regarded as fixed installations in the particular room and not installations that can readily be dismantled from a given room, transported to another room and used here. Even though dismantling and transport to another room may be possible, great costs would be incurred by the transport due to the bulky nature of such absorbers.

Even though acoustic absorbers of the above kind may not have to be transported to another room for application here, it might be desirable under some circumstances to apply a given number of absorbers in a room and under other circumstances a lesser number of the absorbers, or even no absorbers at all might be needed for instance dependent on the kind of musical performance planned for the room. Storage of a large number of rather bulky absorbers in-house could well be a problem in these cases.

SUMMARY OF THE INVENTION

On the above background it is an object of the present invention to provide a device, a system and a method for selectively altering the reverberation time of a room, particularly, although not exclusively, at lower frequencies.

It is a further object of the present invention to provide a device, system and method where the effect on the reverberation time can readily be changed, for instance by changing the absorption coefficient $\alpha$ and/or resonance frequency or frequencies of the device or system or the effective bandwidth hereof. Specifically as mentioned above an essentially on/off function of the absorbing device, i.e. a change between a very high absorption coefficient and a very low absorption coefficient within a certain specified frequency region would be desirable.

It is a further object of the present invention to provide devices and systems, which facilitate transport and storage of the devices and systems.

These and other objects and advantages are according to the invention attained by a sound-absorbing device for placement in a sound field in air, and absorbing acoustic energy from said sound field in a predetermined frequency region, specifically, although not exclusively, a low-frequency region, the device comprising an at least partly flexible body containing one or more cavities, where at least a portion of the outer surface of the body is in contact with said sound field and where said body is inflatable and collapsible by supplying a gas to or removing the gas from said at least one cavity, respectively, whereby the absorption coefficient $\alpha$ and the resonance frequency of said body can be varied, thus determining the frequency region in which maximum absorption will take place.

In principle, the desired altering of the reverberation time of a given room may be accomplished by using a single device as described above—depending for instance on the dimensions of the room, the dimensions of the absorbing device and the various acoustical properties of the device, but in many instances a plurality of such devices will advantageously be used to form a system covering sufficiently large and predetermined areas of the room. Many configurations of such systems are conceivable, and some embodiments hereof will be described in the detailed description of the invention.

Basically, a system for reducing the reverberation time of a room comprises according to the present invention a plurality of sound-absorbing devices of the basic configuration described above, where the system furthermore comprises conduits through which gas can be supplied from a source to each of said bodies and removed from these. The said bodies could either each be provided with valve means for controlling the supply of gas to/removal of gas from each of said bodies separately, or all the bodies of the system—or groups of bodies in the system—could also alternatively be provided with common valve means.

Specifically the valve means could be remote controllable and the system could be provided with a central control device for controlling the static pressure in each of the bodies and hence the compliance or dimensions of each of the bodies separately. Instead of using the static pressure within the bodies as a control quantity, the tension of the material of the bodies could be monitored by for instance piezo-electric devices or the dimensions and shape of the bodies could also be supervised by other means.

The system could furthermore be provided with means for measuring the reverberation time of a room in which the system is installed, thereby facilitating the appropriate set-up of the system. Such means could of course also be provided in connection with only a single device according to the invention. Furthermore the system could comprise data storage means for storing measured reverberation times and corresponding parameter settings of the device or system for later analysis and retrieval, thereby facilitating empirical improvements of the parameter choices (overall absorption area of the devices, required inflation, optimal material characteristics, etc.) of the device or system.

Alternatively instead of actually inflating and deflating the bodies of the device according to the invention by a supply/extraction of air or other suitable gas from the bodies, the bodies can according to the invention be provided with self-inflatable means in the manner of self-inflatable air mattresses, an alternative which will be briefly described in the detailed description of the invention.

The present invention furthermore relates to a method for reducing the reverberation time of a room at least in a low-frequency region from a given reverberation time ($T_{60}$) to a desired reverberation time ($T_{60,S}$) comprising the introduction of one or more bodies into the room, where the required total surface area $S_s$ of said one or more bodies is determined by the equation $$\alpha = \frac{55.3V}{cS_S}\left(\frac{1}{T_{60}^{S}} - \frac{1}{T_{60}}\right) \tag{5}$$

where $\alpha$ is the absorption coefficient, V is the volume of the room and c is the speed of sound. Hence given a certain value of the reverberation time of the room prior to the application of the devices or system according to the invention, the desired reverberation time room and the absorption coefficient $\alpha$ attainable by the device in the particular frequency region, it is possible to calculate the required total surface area of the absorbers and hence the required number of absorbers.

According to a specific embodiment of the present invention, the device, system and method is designed specifically for altering the reverberation time in the frequency region of approximately 63-125 Hz with a maximum absorption coefficient of at least 0.7 and a usable bandwidth of at least one octave, i.e. in the frequency region where many rooms exhibit an unacceptable high reverberation time as described initially in connection with FIG. 1.

It is emphasized that as a supplement to the inflatable/deflatable bodies described above, the device according to the invention could furthermore be provided with absorbing devices effective at higher frequencies. Such combined devices will be described in the detailed description of the invention and the high-frequency absorbers could for instance be provided as a thin sheet of a suitable fabric of a sufficiently high flow resistance to yield it effective as an acoustic absorber at higher frequencies.

BRIEF DESCRIPTION OF THE DRAWINGS

The present invention will be better understood with reference to the following detailed description of various embodiments hereof in conjunction with the drawing, where:

FIGS. 10*a*, 10*b* and 10*c* show schematic perspective views of an actual implementation of the seventh embodiment of the invention.

DETAILED DESCRIPTION OF THE INVENTION

Figure 1:
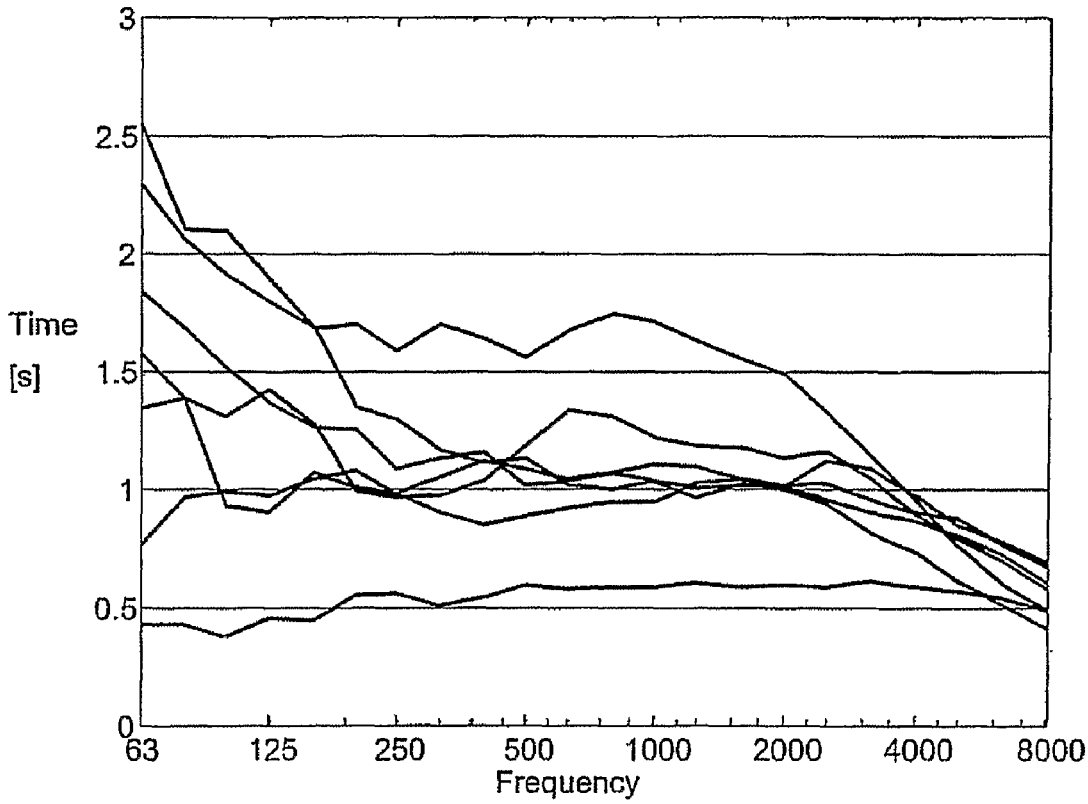
FIG. 1 shows actual measurements of the reverberation time T30 in seven different rooms which can be used for live performances of music as well as reproduction of sound.
Figure 2:
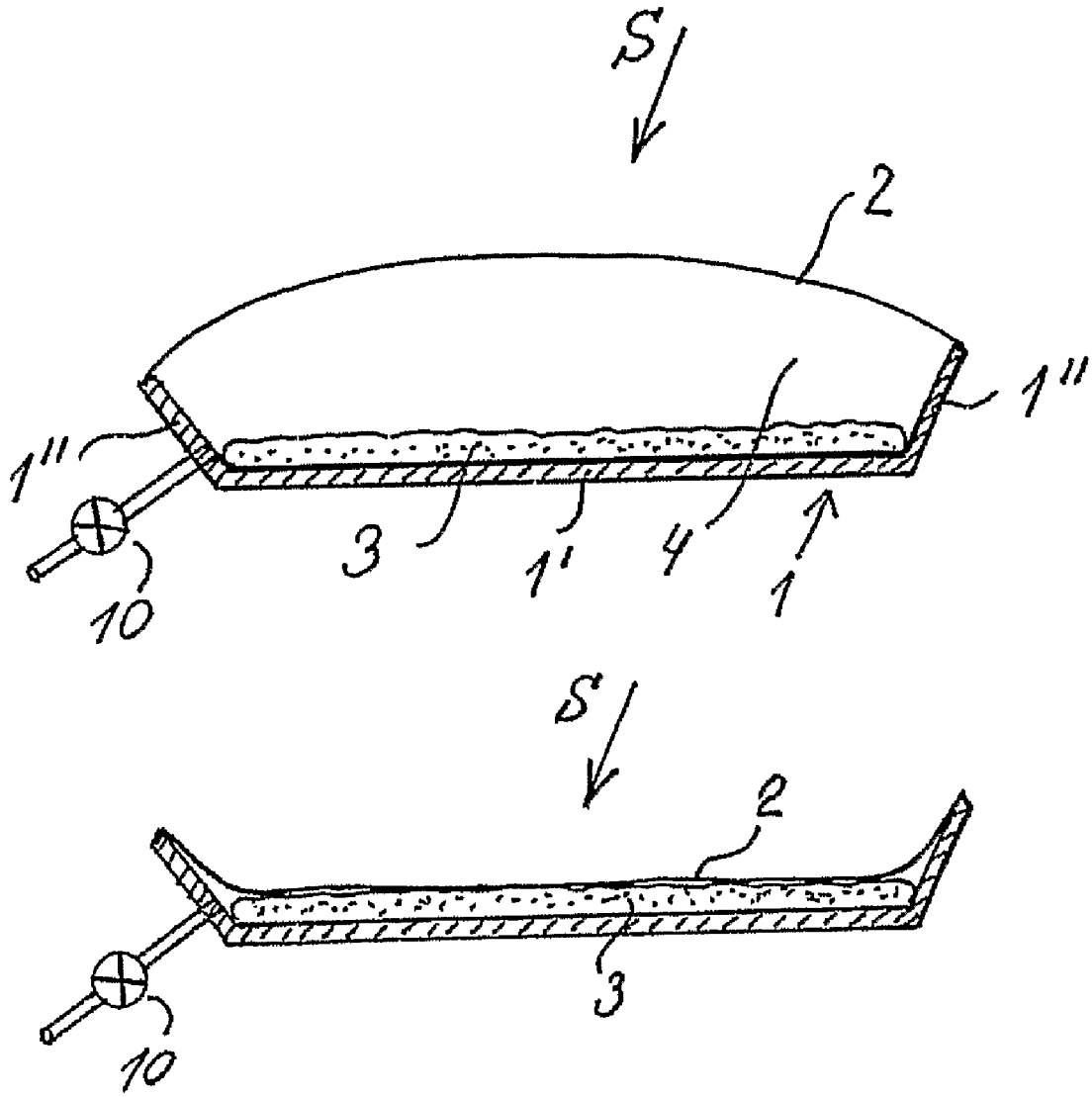
FIG. 2 shows a schematic representation of a first embodiment of a device according to the invention comprising a substantially rigid frame structure covered by a thin, flexible membrane.

Referring to FIG. 2 there is now shown a schematic representation of a first embodiment of a device according to the invention comprising a substantially rigid frame structure 1 comprising edge portions 1" surrounding a central portion 1', thus forming an open box- or tray-like support structure. Opposite the central portion 1' and supported by the edge portions 1" is suspended a thin, flexible membrane 2. The frame structure and the membrane define an internal cavity 4 which can be inflated/deflated with air or another suitable gas via a conduit and valve arrangement indicated by reference numeral 10. The cavity 4 may optionally be provided with a certain amount of acoustic damping material, for instance in the form of a panel 3 of porous material provided at the central portion 1' or in the form of a suspended sheet of fabric with suitable flow resistance, suspended between the edge portions 1" at a suitable distance from the central portion 1'. In the inflated state, acoustic energy of an incident sound field as schematically indicated by S in FIG. 2 will be absorbed by the device, partly due to internal friction in the flexible membrane 2 and provided an acoustic absorbent material is introduced into the cavity 4, partly by friction and thus generation of heat in this material. Maximal absorption will occur at the resonance frequency of the membrane, the resonance frequency being determined by the compliance of the membrane and air cavity and the mass or the membrane as described in the summary of the invention. In order to attain maximum absorption due to the vibration of the membrane itself, the membrane must be made of a suitable material giving rise to the internal friction—and hence conversion of vibrational energy to heat—responsible for absorption of acoustic energy from the incident sound field. Also the mass (per $m^2$) of the membrane and hence the resonance frequency of the device will be affected by the choice of material of the membrane. Examples of materials suitable for membranes for the various devices according to the invention will be given below.

Figure 3:
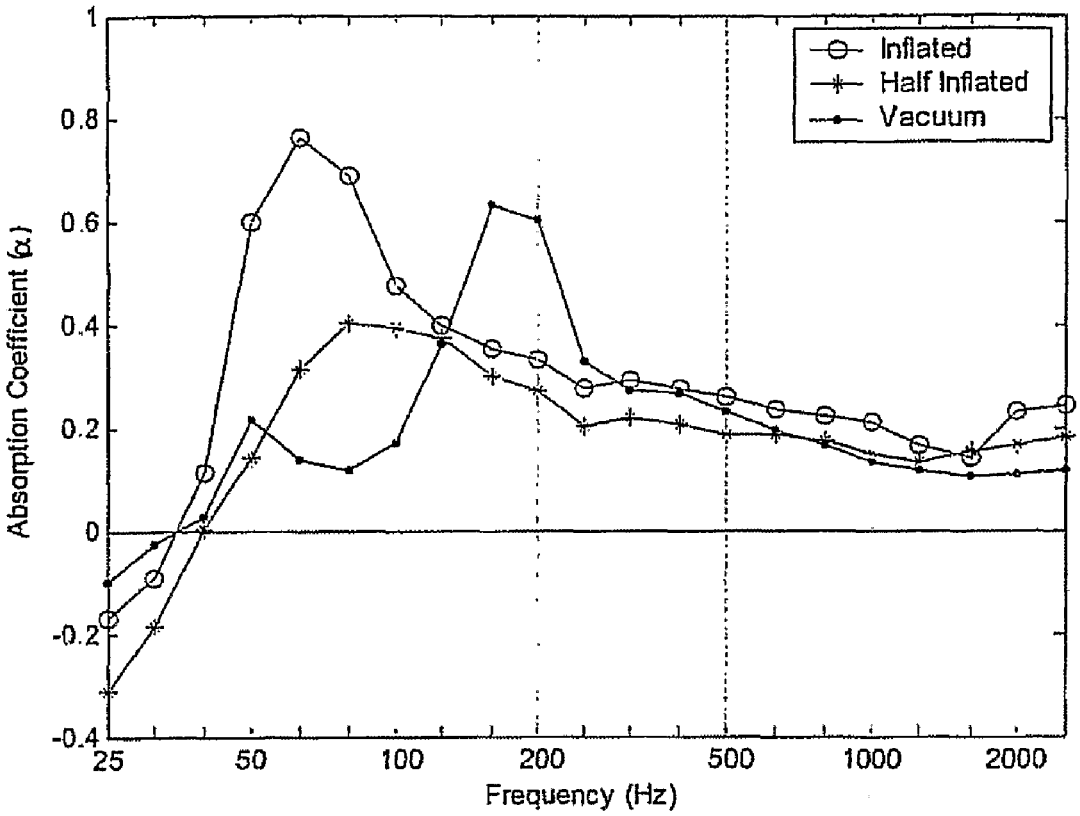
FIG. 3 shows the absorption coefficient ($\alpha$) as a function of frequency of a device according to the invention of the kind shown in FIG. 2.

FIG. 3 shows actual measurements of the absorption coefficient ($\alpha$) as a function of frequency of a device according to the invention of the kind shown in FIG. 2 and provided with an absorbing panel 3 as described above. In the inflated state, an absorption coefficient of close to 0.8, i.e. approximately 80% of the sound energy incident on the membrane is absorbed by the device, is reached at a frequency of 63 Hz and fairly high absorption coefficients are attained in a frequency range of approximately 1 octave around this frequency. Due to the presence of the absorbing material 3 in the cavity 4 of the device, a relatively high absorption coefficient of approximately 0.6 is still attained in the deflated ("vacuum") state although at a higher frequency due to the reduced compliance (i.e. increased stiffness) of the membrane, which is not resting on the surface of the absorption material 3.

Depending on the state of the device, quite high absorption of acoustic energy can thus be attained at and around two different frequencies, i.e. the reverberation time of the room in which the device is installed can be altered at two different frequencies according to the state of the device. If the absorbing panel 3 had not been provided in the cavity 4, significant absorption would still have been attained at and around the frequency 63 Hz, but essentially no absorption would have been attained in the deflated state, thus yielding an on/off device for altering reverberation time.

The device shown in FIG. 3 comprises the above-mentioned substantially rigid frame structure, which could for instance be made of plywood or a moulded plastic material, but for many applications it will be beneficial at least to a large extent to avoid rigid structures in the devices according to the invention, thereby facilitating transport and storage of these devices. This becomes particularly important for mobile applications where a plurality of such devices are to be moved from one location to another and temporarily set up to form a system covering larger areas of a room. For such applications it is desirable if the device according to the invention can be practically completely collapsed and if relatively heavy support structures can furthermore be avoided. The embodiments of the device according to the invention shown in FIGS. 4, 5, 6 and 7 are all of this collapsible type.

Figure 4A:
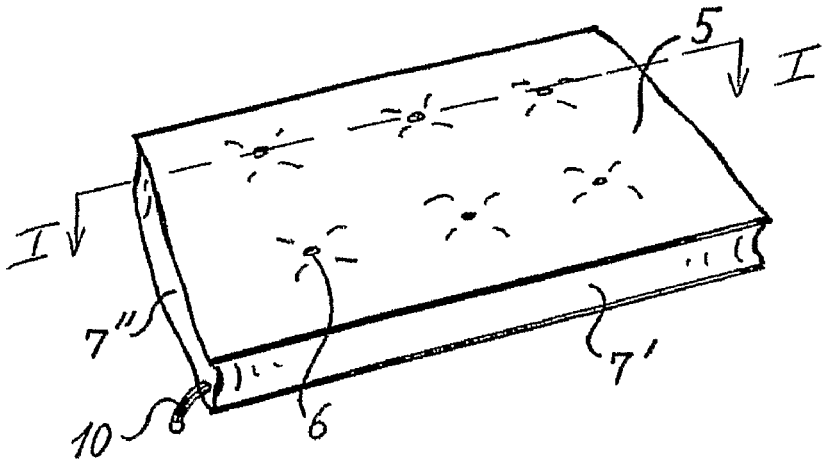
FIGS. 4*a*, 4*b* and 4*c* show a schematic representation of two versions of a second embodiment of a device according to the invention of a "mattress" configuration.
Figure 4B:
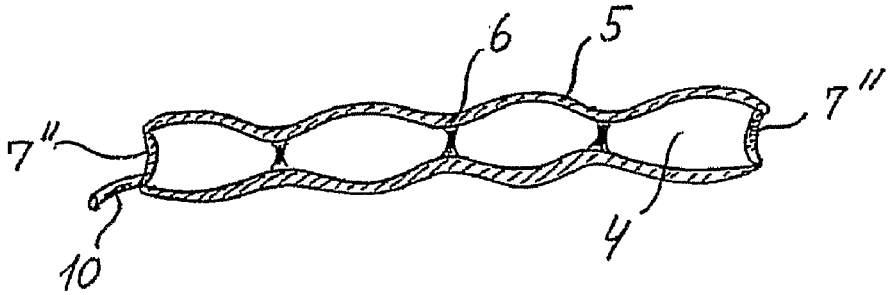
Figure 4C:
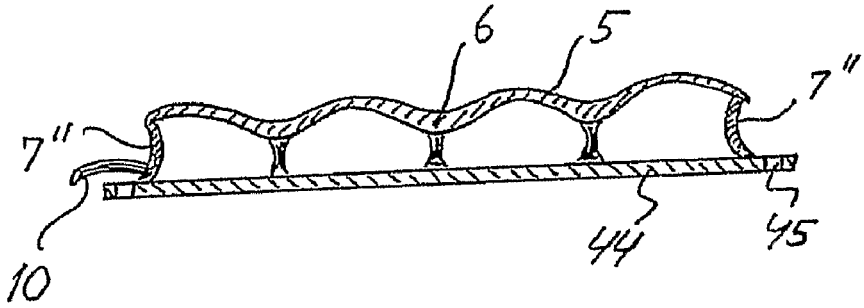

Thus, FIGS. 4*a*, 4*b* and 4*c* show a schematic representation of different versions of a second embodiment of a device according to the invention of a "mattress" configuration. As shown in FIG. 4*a*, the device may have the rectangular shape of a traditional mattress comprising upper and lower (not visible) substantially planar surfaces 5 bounded by edge portions 7', 7", thus forming an internal cavity in the mattress. Both the planar portions 5 and the edge portions 7', 7" are made of a suitable flexible material whereby the mattress can be brought into an inflated state as shown in FIG. 4*a* by the provision of air or other gas under pressure via an inlet 10 with suitable valve means. In order to maintain the inflated mattress in its proper substantially rectangular shape, cross connections 6 are provided internally between the two opposing planar surfaces 5, as is well known in itself. It is understood that other shapes of the mattress than the rectangular shape shown in FIG. 4*a* could also be envisaged without departing from the invention.

FIGS. 4*b* and 4*c* show two cross sectional views of two different versions of the mattress embodiment of the invention. Thus, the version shown in FIG. 4*b* comprises flexible surfaces 5 on either opposing side of the mattress and is provided with the cross connections 6 and the flexible edge portions 7". Devices of this type could for instance be hung from the ceiling or from other support structures, thus providing access for the incident sound field on either of the opposing substantially planar surfaces of the device. Contrary to the device shown in FIG. 4*b*, the device shown in FIG. 4*c* comprises only one flexible surface 5, whereas the opposing planar side of the "mattress" structure consists of a substantially rigid panel 44. This panel may extend beyond the edge portions 7" as indicated by reference numeral 45, thus providing flange-like edge portions facilitating attachment of the device to for instance a ceiling or a wall.

Figure 5A:
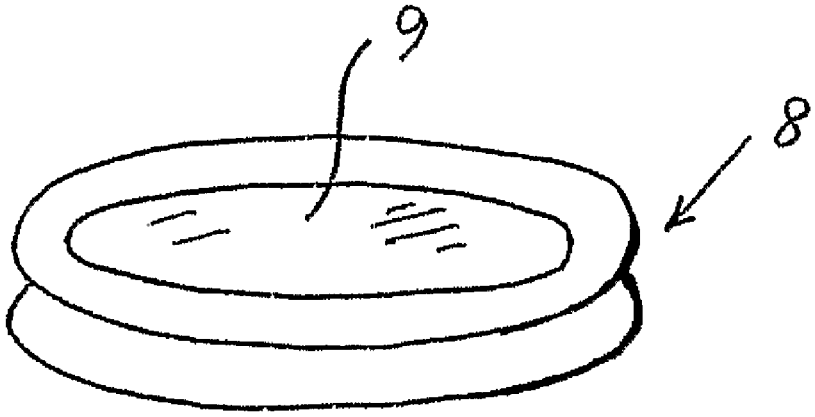
FIG. 5 shows a schematic representation of a third embodiment of a device according to the invention comprising an inflatable frame structure for suspension of at least one flexible membrane.
Figure 5B:
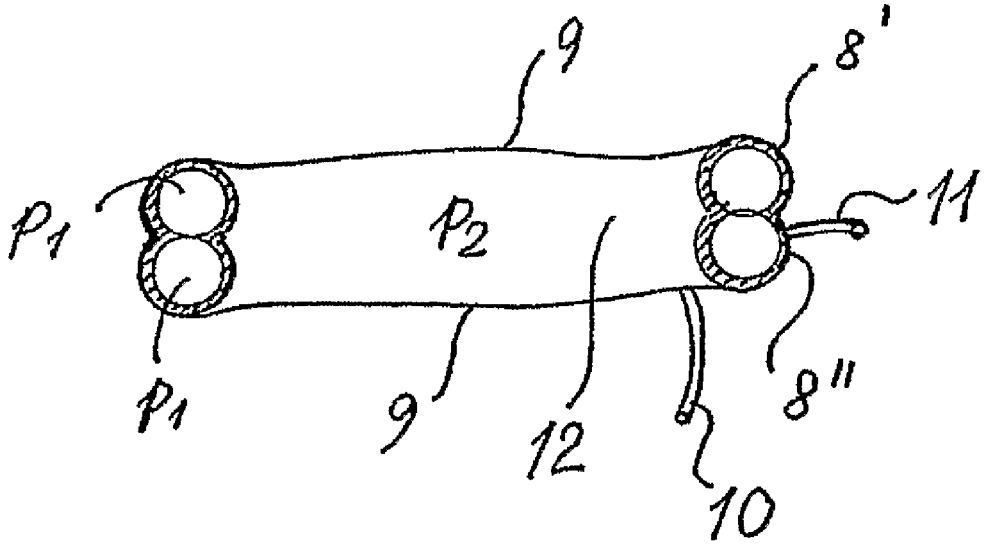
Figure 6:
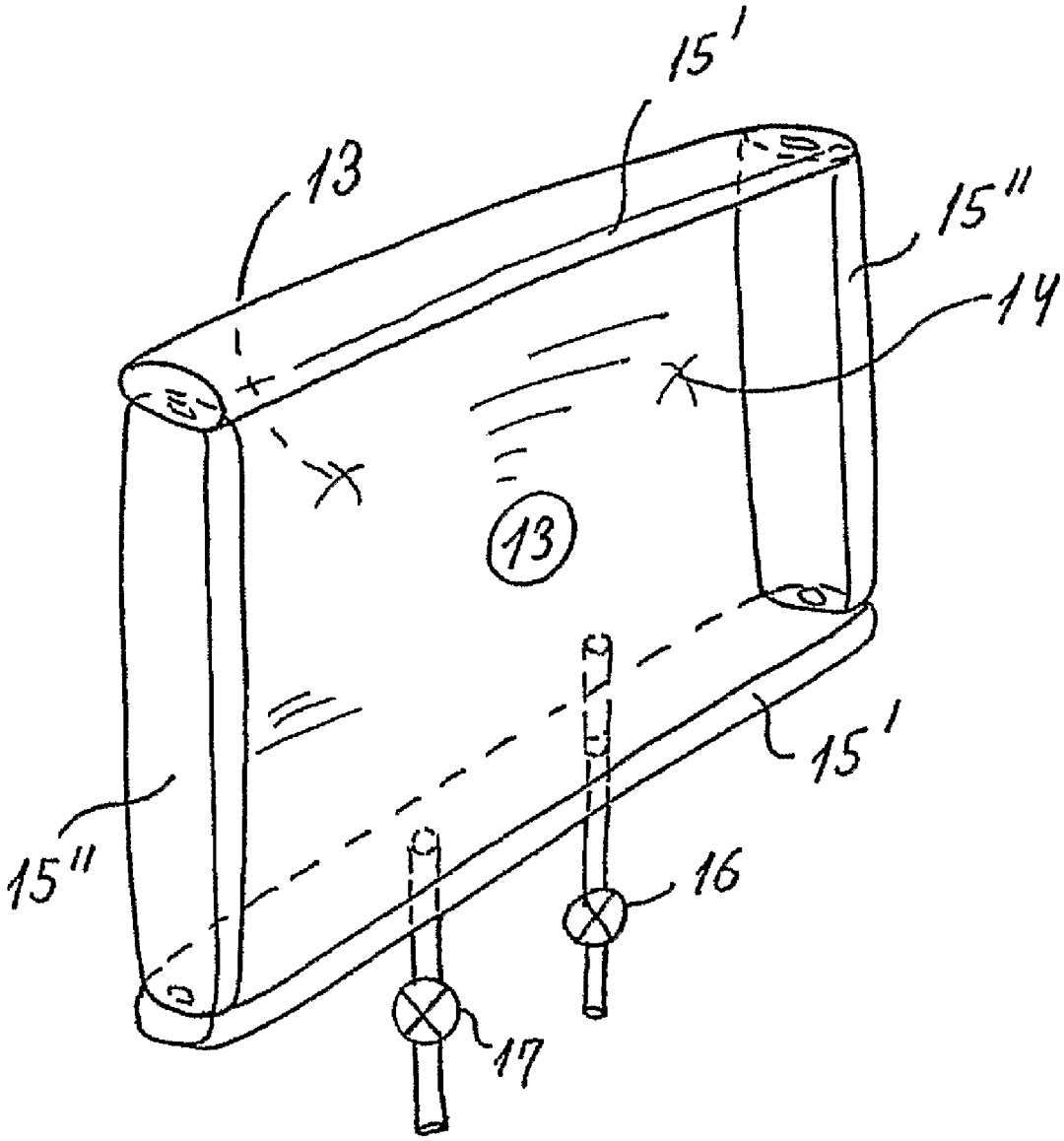
FIG. 6 shows a schematic representation of a fourth embodiment of a device according to the invention, which is an alternative to the one shown in FIG. 5.

FIG. 5 shows a schematic representation of a third embodiment of a device according to the invention of the collapsible type comprising an inflatable frame structure 8', 8" for suspension of at least one flexible membrane 9, although one of these may also be a substantially rigid panel as in the previous embodiment. The frame structure may be provided by the hollow toroidal structure 8' and 8" shown in FIG. 5 and inflated with air at a pressure $p_1$ above atmospheric pressure via the inlet and valve member 11 in order to attain a relatively rigid frame structure. Suspended over this frame structure is either one or two flexible membranes 9, whereby a cavity 12 is formed between the membranes. The cavity 12 can be varied (inflated/deflated) by controlling the pressure $p_2$ of air or other gas within the cavity, the cavity being also provided with inlet and valve means 10. Also in this embodiment, other shapes than the cylindrical shape shown may of course be envisaged without departing from the invention, as exemplified by the embodiment shown in FIG. 6 comprising inflatable edge portions 15', 15" forming an inflatable rectangular frame structure over which flexible membranes (or one membrane and a substantially rigid panel) 13, 14 can be suspended. Separate inlet and valve members 16, 17 are also present in this embodiment for controlling the pressure in the respective cavities.

Figure 7:
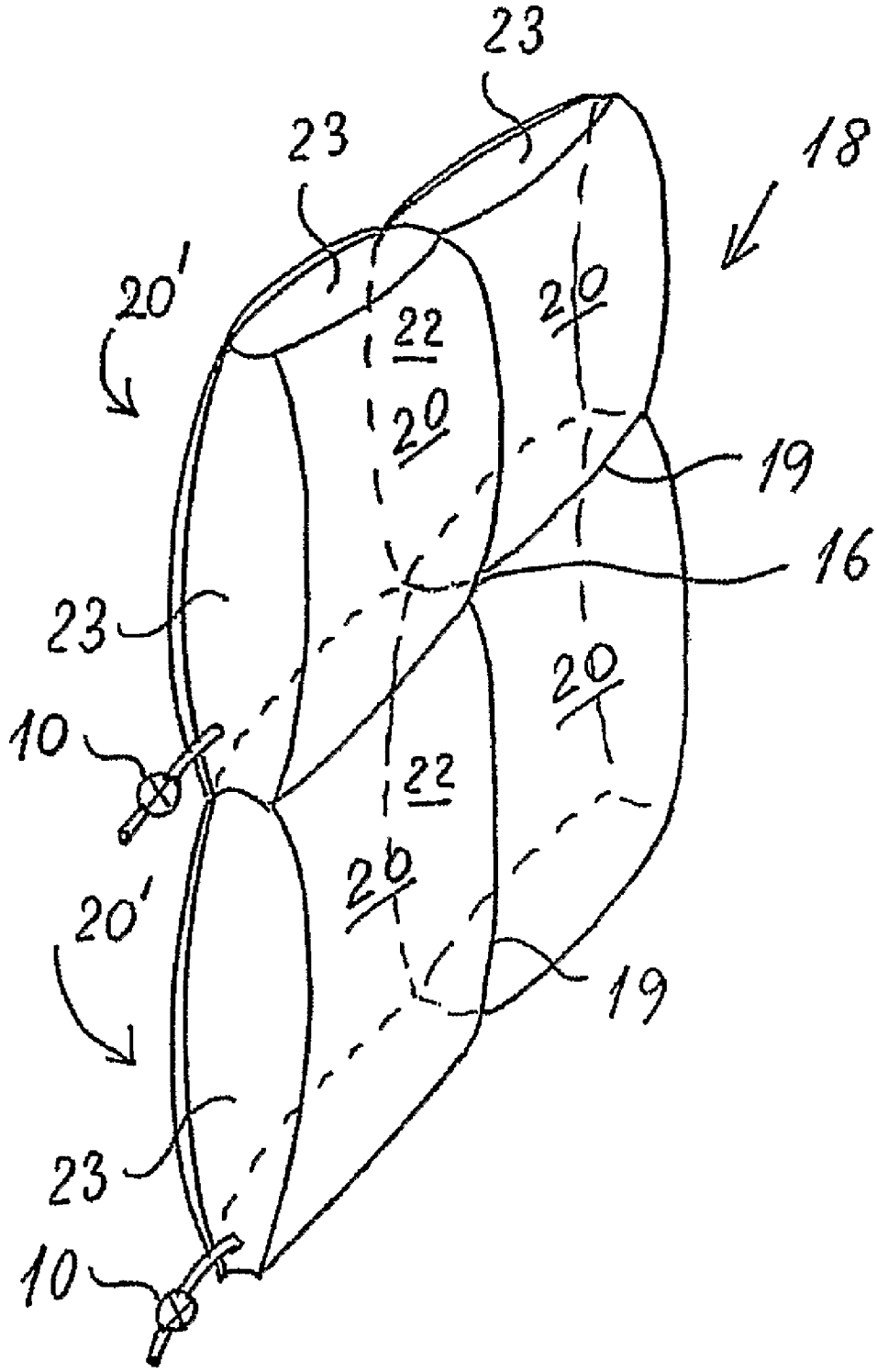
FIG. 7 shows a schematic representation of a fifth embodiment of a device according to the invention of an "ice bag" structure.

FIG. 7 shows a schematic representation of an embodiment of a device according to the invention of an "ice bag" structure somewhat resembling the mattress structure shown in FIGS. 4*a*, 4*b* and 4*c*. The device is generally indicated by reference numeral 18 and comprises a body of a mattress-like structure subdivided into a plurality of portions 20, 20', which portions may be of identical shape and dimensions, although this is not a requirement, the individual portions being bounded by a bracing structure 19. The individual portions, each defining an internal cavity 21 may be in fluid connection with each other or a given portion may be in fluid connection with certain other adjacent portions, whereby air or other gas used for inflating the device can be provided at a given inlet and valve member and flow to the other of the said portions. It is, however, also possible to provide partitions 22 between adjacent portions and thereby subdividing the device into a number of sections, for instance the rows or columns of the matrix-like structure shown in FIG. 7. Each of these sections is then provided with separate inlet and valve members 10 for inflating/deflating the portions of the particular section.

Figure 8A:
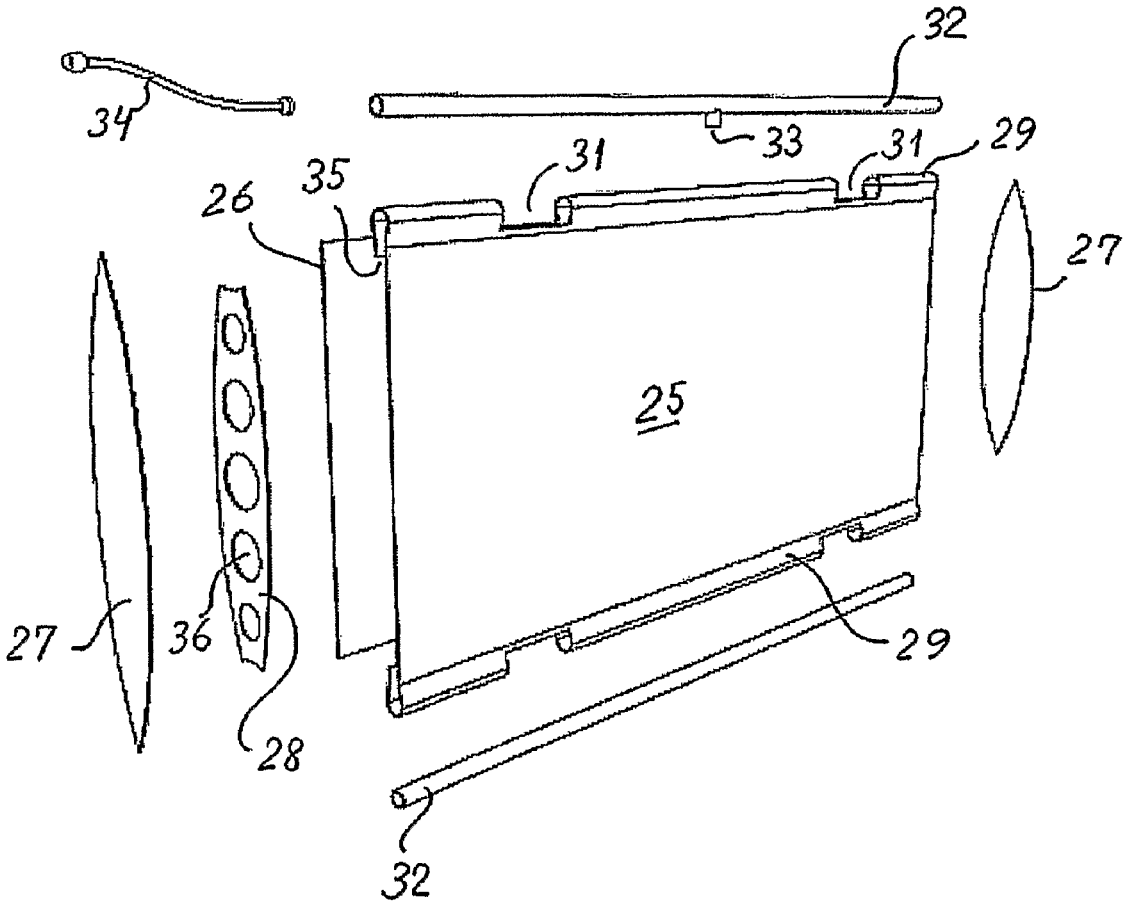
FIG. 8*a* shows a schematic perspective exploded view of a sixth embodiment of a device according to the invention.
Figure 8B:
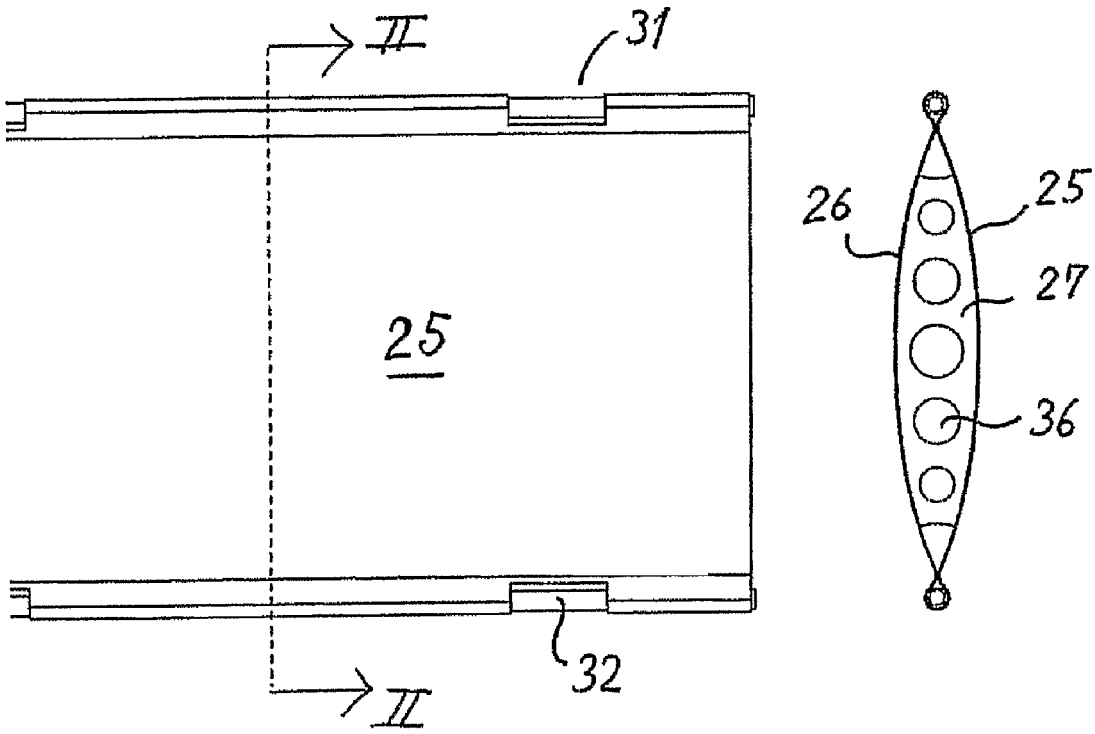
FIG. 8*b* shows a plane view and a cross-sectional view of the embodiment shown in FIG. 8*a;*
Figure 8C:
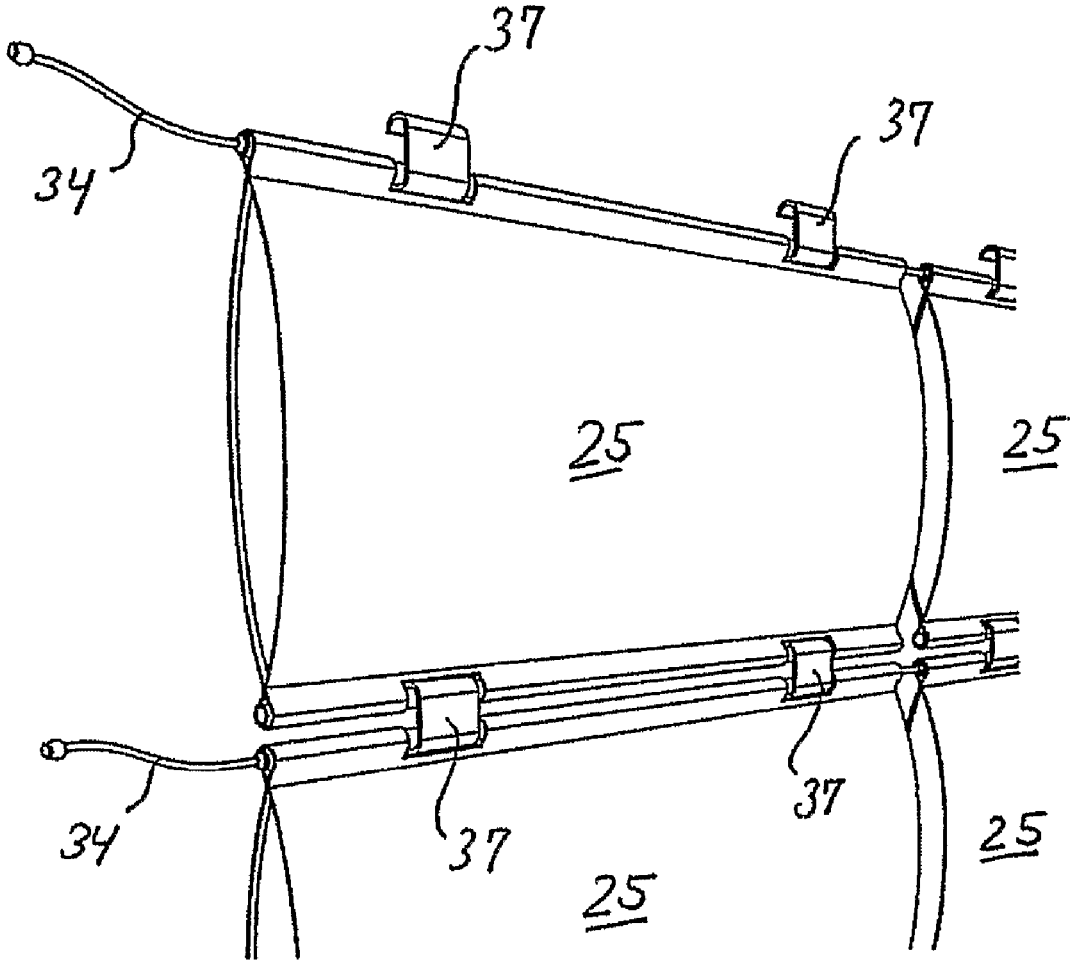
FIG. 8*c* shows a schematic perspective view of a system of devices according to the invention assembled to form a system for altering the reverberation time of a room.

Now referring to FIG. 8 there is shown a sixth embodiment of a device according to the invention. Specifically FIG. 8*a* shows a schematic perspective exploded view of this embodiment comprising opposing membranes 25 and 26 suspended between opposing substantially linear longitudinal edge portions 29 of a spilt-up cylindrical configuration provided with a slit 35 through which the membranes 25, 26 can be introduced into the edge portions and afterwards attached to the edge portions (and to each other) in an airtight manner, thus defining an internal cavity between the membranes and opposing end portions 27, the end portions being also secured to the membranes and the edge portions in an airtight manner. The end portions 27 could be made of a single sheet of a suitable flexible material but it would also be possible to form the end portions 27 as inflatable bodies in order to increase the rigidity (moment of inertia) about the relevant plane and thereby also prevent a cylindrical configuration in the inflated state of the device. One or more intermediate shape retainment members 28 may be provided at appropriate locations within the internal cavity in order to attain the desired shape of the device in its inflated and deflated states. The shape retainment members 28 are provided with suitable passages 36 to allow passage of air or other gas between the various compartments formed within the device by the introduction of the members 28. The longitudinal edge portions 29 can accommodate correspondingly shaped (i.e. in the case shown in FIG. 8 substantially cylindrical) longitudinally extending rods 32, which are accessible through recesses 31 in the edge portions, which may serve the dual purpose of suspension of the device or connection of a given device to an adjacent device as shown in FIG. 8*c*, whereby systems of devices can be built up and of providing the internal cavity of the device with air or other gas from an external source via a hose or other pipeline 34 (with suitable valve means) provided the rod 32 at least along a certain longitudinal extension hereof is provided with an internal passage communication with the cavity of the device through a side branch 33. In FIG. 8*b* a plane view and a cross sectional view along line II-II is shown, thus showing the double-convex lens-shaped configuration of the embodiment shown in FIG. 8. It is, however, understood, that other cross sectional shapes may also be chosen without departing from the invention. Finally, FIG. 8*c* shows a part of a system of devices according to this embodiment of the invention, where individual vertical columns of devices are hung for instance from a ceiling or other support structure, each of the devices being connected to the adjacent devices by connecting members 37 formed for releasable engagement with the rods 32 through the recesses 31 in the edge portions described above. Air or other suitable gas is provided to the devices from an external source via a hose or pipeline 34 at the outermost column of devices as shown in FIG. 8*c* and between devices of adjacent columns via short hoses or pipelines 38. It is understood that other patterns of fluid interconnections between the various devices can be envisaged without deviating from the system of devices according to the invention.

Although not specifically shown or described in detail it is understood that the air or gas supply lines to individual devices according to the invention or to various groups of devices according to the invention can be provided with valve means to control the flow of air or other gas into and out of the devices. Thus, for instance it would be possible to provide each individual device with its separate valve means and thereby be able to control the inflation of each individual device separately. The valves may be manually operated but remote controllable valves, controlled for instance by a central control system as mentioned in the following, could also be envisaged.

Now referring to FIG. 9 there is shown a schematic perspective view of a seventh embodiment of a device according to the invention mounted on a boundary 40 of a room and provided with both low-frequency and high-frequency absorbing members 42 and 46, respectively, whereby the reverberation time of the room may not only be altered at low frequencies but also at higher frequencies. It should be emphasised that although the device according to this embodiment is shown and described mounted on a boundary, it may alternatively be designed for free suspension for instance from a ceiling, in which case a high-frequency absorbing device (fabric etc.) 46 may be provided on either side of a central low-frequency absorbing device 42.

Figure 9A:
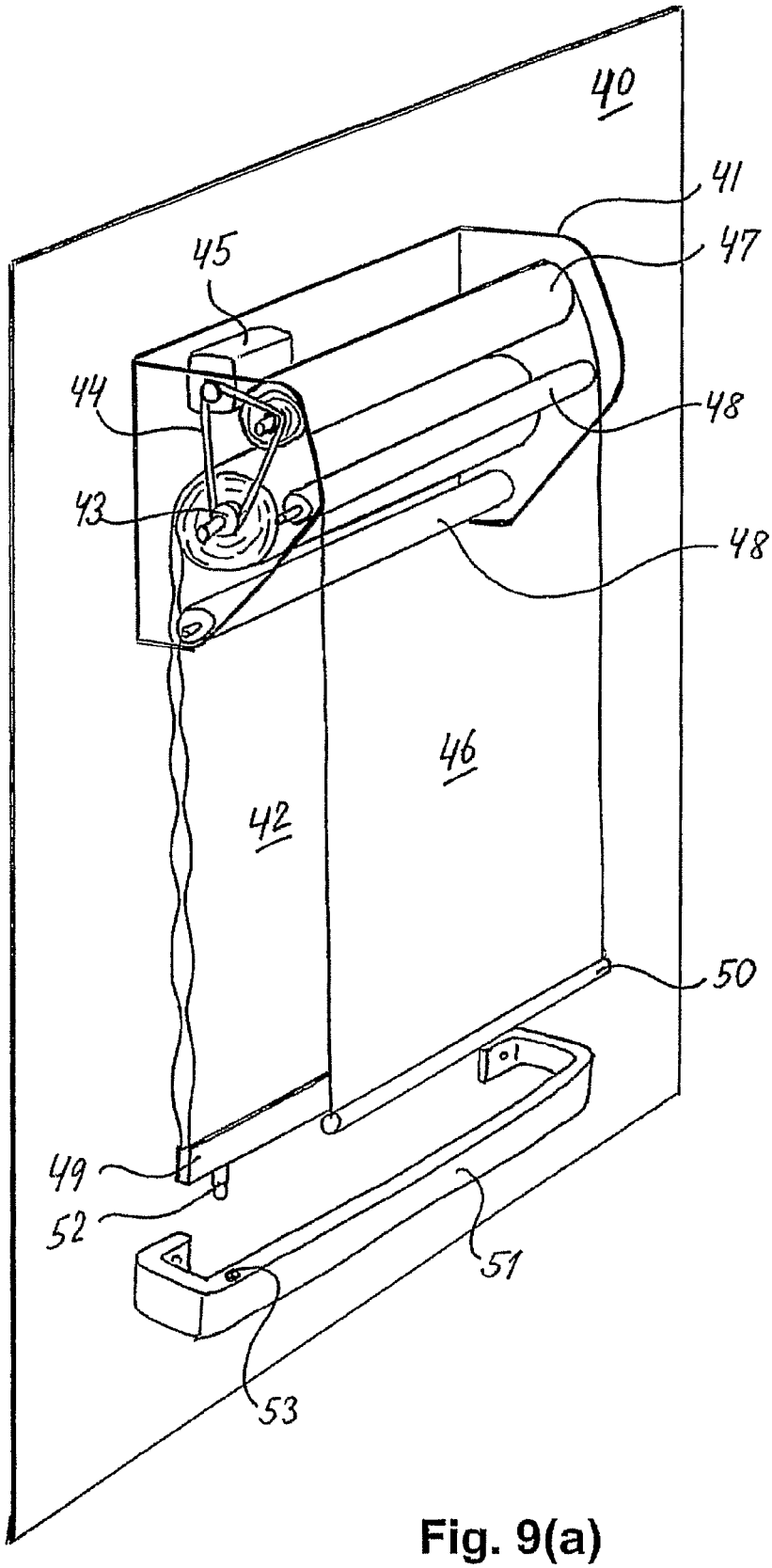
FIG. 9*a* shows a schematic perspective view of a seventh embodiment of a device according to the invention mounted on a boundary of a room and provided with both low-frequency and high-frequency absorbing members.

Reverting to FIG. 9*a* there is shown the seventh embodiment of a device according to the invention comprising a low-frequency absorbing device 42 according to the invention, for instance a device of the "mattress" design or "ice-bag" design described previously in connection with FIGS. 4*a*, 4*b* and 7, respectively, and a high-frequency absorbing device 46, for instance a suitable fabric. In the deflated state, the low-frequency absorbing device 42 is wound around a drum 43, the drum being mounted for rotation around its longitudinal axis in a supporting/suspension structure or bracket 41 and driven by a motor 46 through a belt 44 or other equivalent means. The motor may be remote-controlled for instance from a central control system, which may also control and supervise other functions of the device or system of devices. Similarly the high-frequency absorbing device 46 is in this embodiment wound around a drum 47 and guided over a suitable roller 48 to a drawn out position substantially in parallel with the low-frequency absorbing device. As shown in FIG. 9*a* the motor drives both absorbing devices 42 and 46, but it would also be possible to provide separate drives for each of these devices, whereby one of these could be brought into its active, drawn out position with the other remaining inactive. The absorbing devices may also be operated manually if desired.

Figures 9B, 9C, 9D:
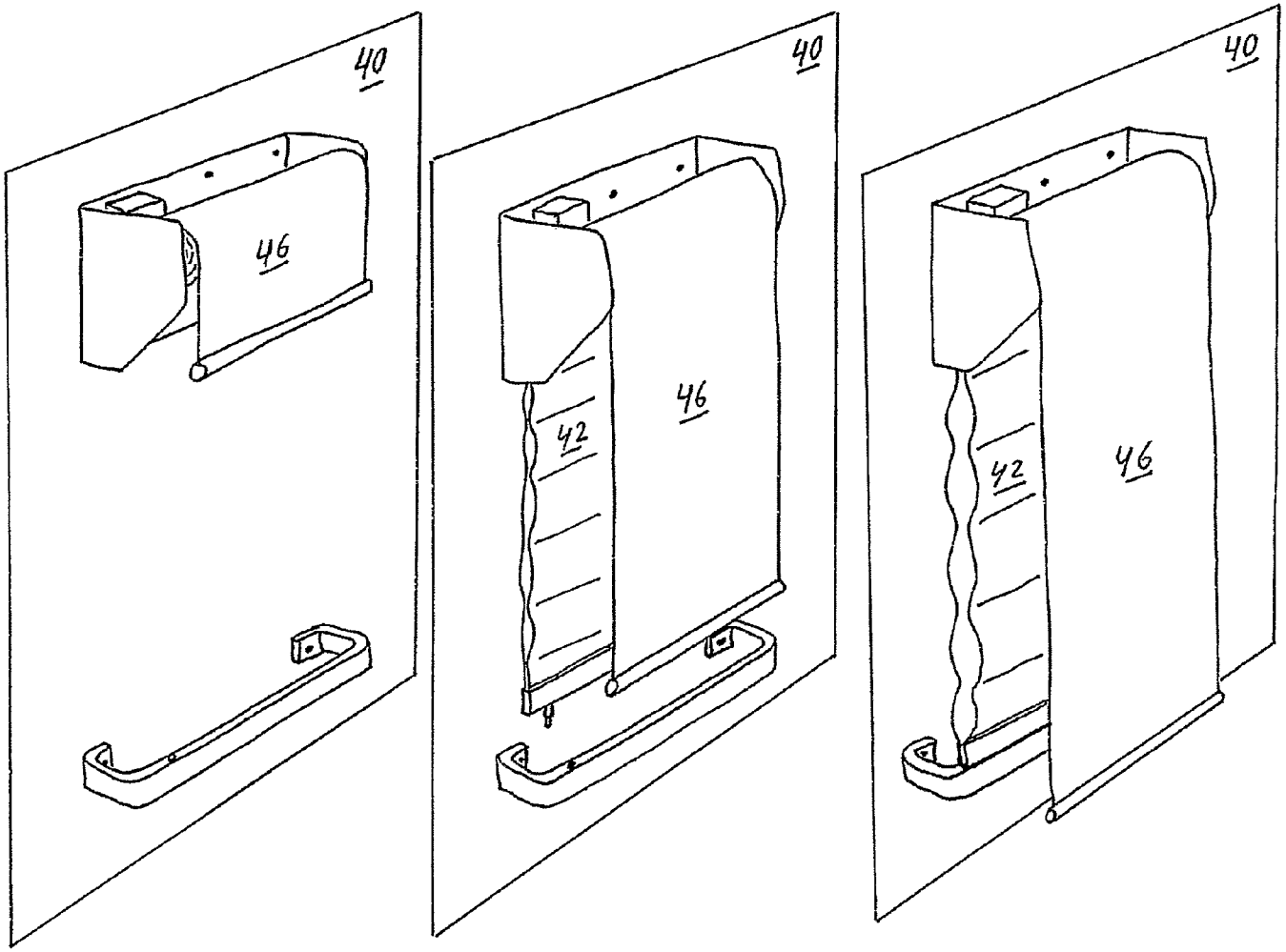
FIGS. 9*b*, 9*c* and 9*d* show schematic perspective views of the embodiment of the invention shown in FIG. 9*a* in three different conditions.

At the lower end of the absorbing devices 42 and 46, these are provided with bottom rails 49 and 50, respectively, where the bottom rail 50 of the high-frequency absorbing device mainly serves to provide the necessary weight to the lower end of this device to make it extend downward in a substantively planar fashion, parallel with the low-frequency absorbing device. The low-frequency absorbing device 42 will generally be much heavier than the high-frequency absorbing device 46, and the bottom rail 49 of the low-frequency absorbing device 42 can be used primarily for providing a fixed attachment to a bottom support 51 mounted on the wall 46 and for the provision of the inlet and valve member 52 through which air or other gas is supplied to/withdrawn from the device 42. The bottom support 51 may be provided with means for establishing fluid connection between the inlet and valve member 52 and a source, although the device 42 may also be supplied with air or gas by other means. The valve may also be provided in the bottom support 51 in stead of in the inlet 52 to the device 42. FIGS. 9*b*, 9*c* and 9*d* show three different states of this embodiment of the invention, i.e. (b) essentially inactive, (c) high-frequency absorbing device active but low-frequency absorbing device inactive, as it has not yet been inflated and (d) both devices active.

Although FIGS. 9*a* through 9*d* show a device comprising both a low-frequency absorbing part 42 and a high-frequency absorbing part 46, it is emphasised that supporting/suspension structure 41 could also be formed for only comprising the low-frequency absorbing device 42 in cases where no modifications of high-frequency reverberation time are needed. Also the structure 41 may be formed for comprising a high-frequency absorbing device 46 on either side (front and rear) of the low-frequency device 42.

In any of the embodiments shown in FIGS. 4 through 9, the inflatable low-frequency absorbing devices may comprise one or more internal cavities without acoustic damping material provided in the cavities. In these cases the absorbing effect is due primarily to internal friction in the membranes themselves. It is, however, also possible to provide acoustic damping material within the cavities, which material could for instance be a panel of porous material such as mineral wool, etc. or a thin sheet of fabric, etc., with a sufficiently high acoustic flow resistance.

Although it would be possible to use the various absorbing devices according to the invention individually, provided they were of sufficient surface area to attain the desired effect on reverberation time of the room, it is also possible to assemble larger modular systems of absorbing devices according to the invention, thereby attaining the desired surface area necessary to attain the required effect on reverberation time of the room. Such systems could for instance comprise a matrix structure of absorbing devices with a given number of rows and columns, the individual devices being connected in a chosen manner by pipelines providing the air/gas for inflating the absorbing devices to the degree necessary to attain the required resonance frequency and absorption coefficient as described previously and for the supply of air/gas the inflatable frame portions described in connection with some of the embodiments.

Each individual absorbing device may be provided with its own valve means as described, or valve means may be provided for certain groups of devices. The valve means may be remote controllable (infrared, Bluetooth etc.) for instance from a central control console, from which the inflation/deflation of the devices may be controlled. Also the system may comprise sensors for measuring the pressure of the devices, thereby providing for the possibility to supervise the correct functioning of the system from the control console. Furthermore, the system may comprise means for measuring the reverberation time of the room, for instance before and after inflation of the absorbing devices. It is even possible using a system of absorbing devices according to the invention to tune the devices to different resonance frequencies, for instance to attain a broader effective frequency region for altering the reverberation time of the room.

Typically the absorbing devices could be tuned to resonance frequencies of 63 Hz or 125 Hz, but this is only to be regarded as typical resonance frequencies.

In a practical implementation, a system could comprise for instance one hundred absorbing devices according to the invention and be controllable from a dedicated control console. Alternatively, control and supervision could take place from a portable personal computer provided with appropriate software to be delivered with the system. This software could provide for the possibility to measure the reverberation time as described above and furthermore comprise an algorithm which—based on entered physical dimensions of the room and the expected number of listeners—could calculate the total number of absorbing devices necessary in order to attain optimal reverberation time. Also previous data (for instance pre and post reverberation times of other rooms in which the system has been used) could be stored in appropriate data storage means for later analysis and retrieval.

As mentioned in the summary of the invention, an alternative embodiment of the device according to the invention comprising means for self-inflation (or self-extension) of the air or gas-filled bodies of the devices would also fall within the scope of the present invention. This embodiment would correspond somewhat to the self-inflating mattresses used for instance for camping etc. and could comprise an outer air of gas impermeable envelope internally provided with for instance a sponge rubber structure facilitating the extension of the device to its proper depth/dimensions, when it is not prevented from such extension. This embodiment of an absorbing device could thus for instance form part of the device described above as the seventh embodiment although it may also be used in many other connections.

It is furthermore noted that in case the pressure $p_2$ of the air or gas in the cavities of the inflatable/expandable bodies is equal to the surrounding atmospheric pressure, any valve means in the supply lines to the bodies may be left open during operation of the devices, assemblies and systems according to the invention.

Figure 10A:
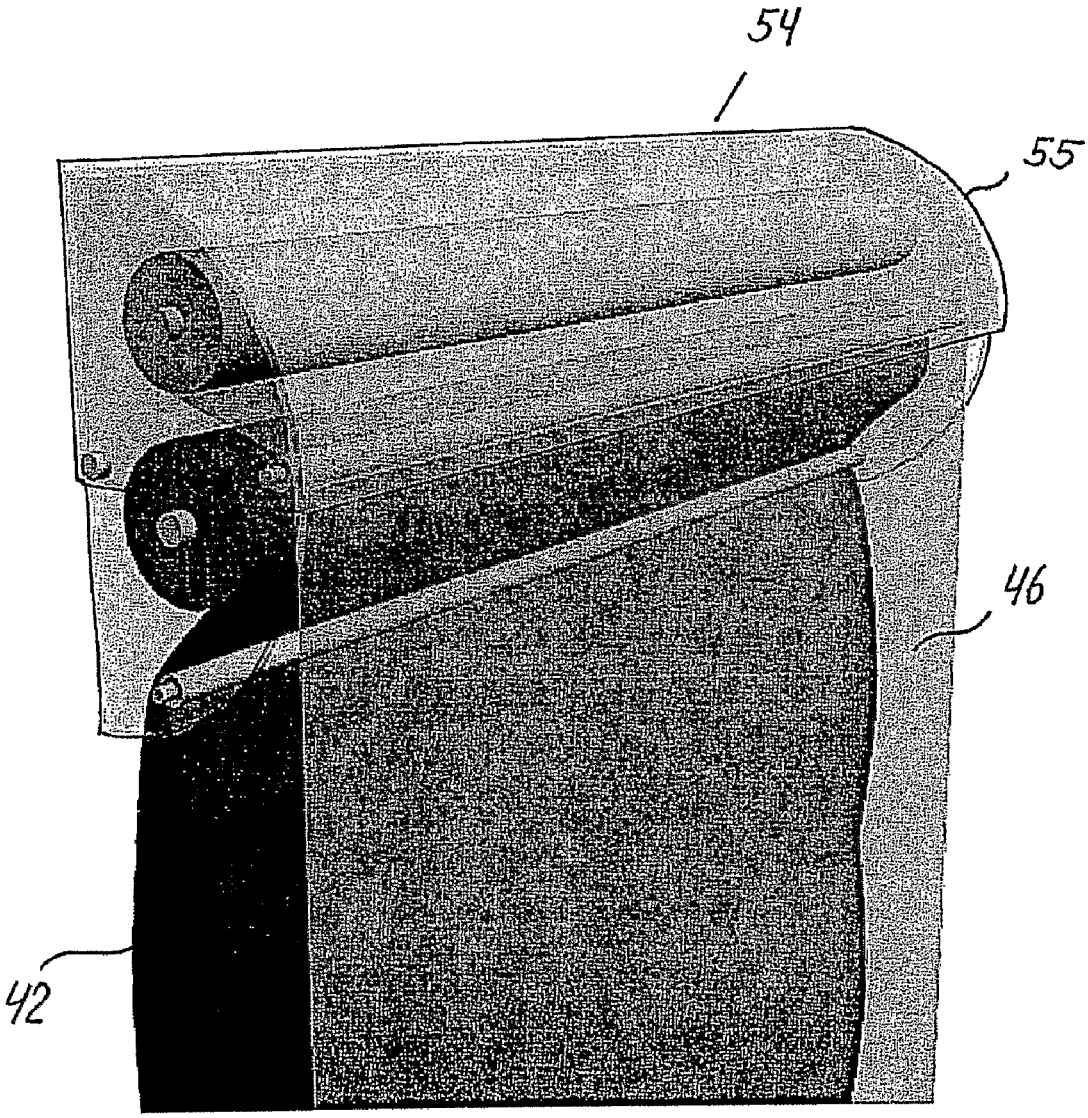
Figure 10B:
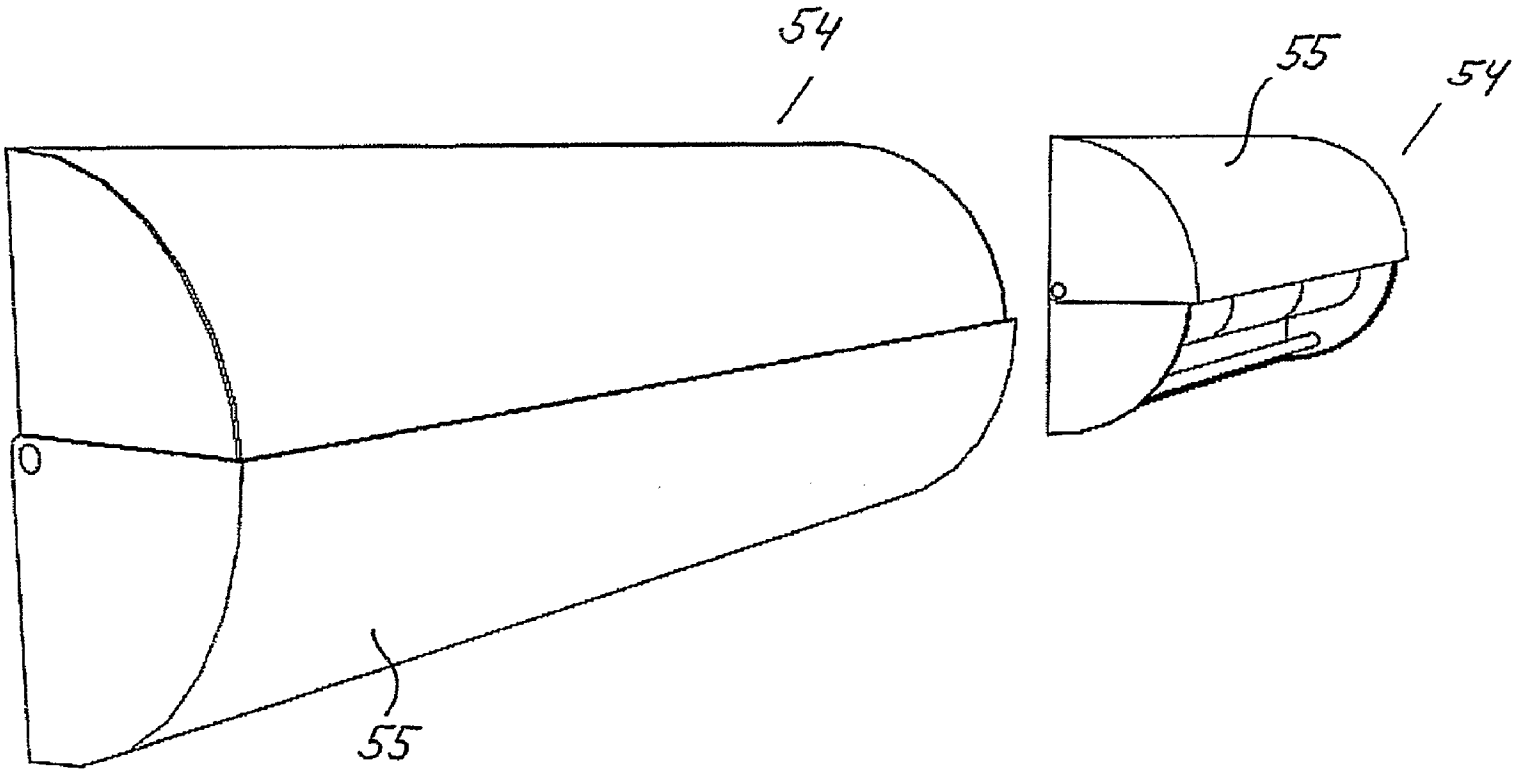

Referring to FIG. 10*a* there is shown a practical design of the supporting/suspension structure 41 of the seventh embodiment of the invention described above. This structure is according to the shown implementation formed as a housing 55 accommodating the rollers for the low- and high-frequency absorbing devices such that these devices—or one of these—may be housed partially or completely within the housing. The provision of the housing may serve both as a general protective means for the devices, when these are not in use and also as a fire protection means. Thus the assembly or system may be provided with means for detecting fire/smoke, which means will activate the drive mechanism in the assembly and thereby retract either one or both of the absorbing devices 42, 46 into the housing. Specifically as shown in FIGS. 10*a* and 10*b*, the housing may be provided with an upper portion 55 pivotally connected to the main body of the housing 54 such that the upper portion 55 will automatically rotate to the closed state of the housing shown to the left of FIG. 10*b* in case of fire. The housing may of course also be closed by the upper portion 55 as a general protective measure for the absorbers accommodated by the housing.

Figure 11:
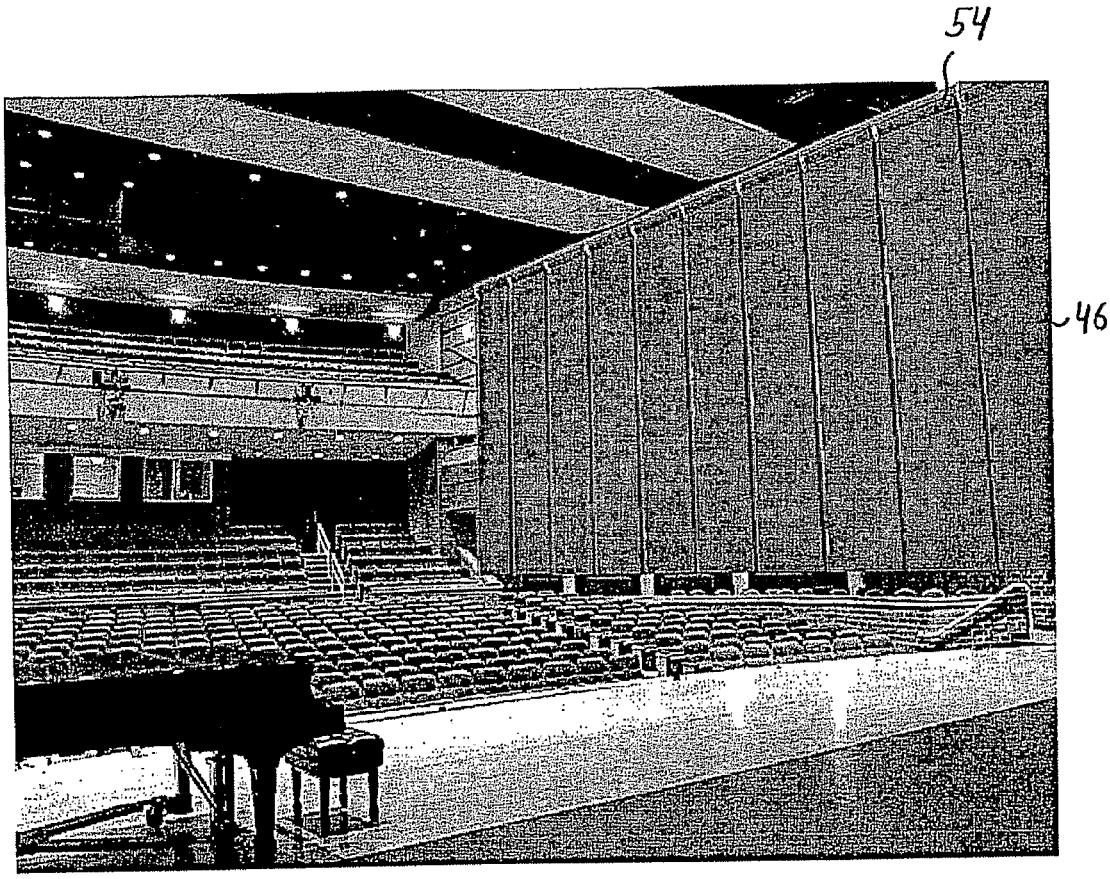
FIG. 11 shows a computer simulation of an installation of a system according to the present invention in a concert hall.

Referring to FIG. 11 there is finally as an illustrative example shown a computer simulation of a system of sound-absorbing assemblies according to the invention suspended along one boundary of a concert hall for altering the reverberation time of the hall.

The inflatable/extendable and collapsible/compressible bodies according to the invention must be able to absorb acoustic energy from a surrounding sound field. As already mentioned under the background of the invention, this ability relates to the impedance ratio of the internal losses of the flexible material of the absorptive bodies and the external radiation resistance of the absorptive bodies. For the embodiment shown in FIG. 2, and with the resulting absorption coefficient shown in FIG. 3, a 2 mm thick Rianyl®, which is a PVC material with a density of 2.96 kg/m$^2$, has been applied. It is, however, understood that other materials may be used for the absorptive bodies according to the invention, for instance suitable polymer materials mixed with sand or other granular material, whereby the weight/density of the material is increased without increasing the wall thickness of the absorptive bodies.

The invention claimed is:

1. Sound-absorbing device which is placed in a sound field of open air for absorbing acoustic energy from the open air in said sound field at least in a predetermined low-frequency region, the device comprising:

a body containing one or more cavities, each said cavity including an active outer surface in free and movable contact with the open air of said sound field and additionally being free and movable for absorption of acoustic energy from the open air of said sound field, and having a volume which is movable in use at least by movement of said active outer surface in the open air of the sound field between states where the volume is one of a) inflated and collapsed or b) extended and compressed, by a variation in a gas pressure therein, in order to change one of an absorption coefficient $\alpha$ or a resonance frequency of said body between a very high value and a very low value substantially lower than the very high value; and a means for actively varying the gas pressure in said one or more cavities in use in order to actively vary at least one of the absorption coefficient $\alpha$ or the resonance frequency of said body between the very high value and the very low values substantially lower than the very high value.

2. Sound-absorbing device according to claim 1, where said low-frequency region has an upper frequency limit of approximately 200 Hz.

3. Sound-absorbing device according to claim 1, where said low-frequency region is 50 Hz to 125 Hz.

4. Sound-absorbing device according to claim 1, where a material of said body is chosen such that there exists a substantial impedance match between the body and the open air of the sound field, at least in said low-frequency region.

5. Sound-absorbing device according to claim 1, where said gas pressure is varied via a valve provided in a conduit between said at least one cavity and a source of gas, where the valve is provided with means for remote-controlling of the valve.

6. Sound-absorbing device according to claim 1, where the body is furthermore provided with an attachment mechanism for engagement with a corresponding attachment mechanism provided on one or more sound-absorbing devices.

7. Sound-absorbing device according to claim 1, where at least one of said one or more cavities is provided with sound-absorbing material within said cavity.

8. Sound-absorbing device according to claim 1, where at least one of said one or more cavities is provided with one of an internal self-inflating or self-expanding mechanism.

9. Sound-absorbing device according to claim 1, where said body is surrounded by one of an inflatable and collapsible frame structure or an expandable and compressible frame structure for providing at least one of a sufficient rigidity, a desired shape or a desired depth to said body.

10. Sound-absorbing assembly comprising:

at least one sound-absorbing device which is placed in a sound field in air for absorbing acoustic energy from said sound field at least in a predetermined low-frequency region, comprising a body containing one or more cavities, said body including an outer surface with at least a portion thereof in contact with said sound field, and being movable between states where the body is one of a) inflated and collapsed or b) extended and compressed, by a variation in a gas pressure therein, and a means for actively varying the gas pressure in said one or more cavities in order to actively vary at least one of the absorption coefficient $\alpha$ or the resonance frequency of said body; and a structure provided with a roller upon which said at least one sound absorbing device can be wound and a drive mechanism for rotating said roller.

11. Sound-absorbing assembly according to claim 10 furthermore comprising at least one high-frequency absorbing device supported on the structure on a second roller upon which said high-frequency absorbing mechanism can be wound.

12. Sound-absorbing assembly according to claim 11, wherein the structure is formed as a housing for accommodating the low and high-frequency absorbing devices in an inactive state of the assembly.

13. Sound-absorbing assembly according to claim 10, further comprising a winding means for automatically winding up the low-frequency absorbing device.

14. Sound-absorbing assembly according to claim 11, where said high-frequency absorbing device is a sheet of fabric of a material with sufficient flow resistance to provide high-frequency acoustic absorption.

15. A method for variably absorbing sound from open air in a sound field of open air, comprising the steps of:

introducing into the open air of the sound field a series of partially resilient bodies, each body having an acoustic mass and a compliance determining a resonance frequency and hence determining an active frequency region for substantial absorption of acoustic energy from the open air in said sound field, and an active outer surface exhibiting a chosen acoustic resistance; such that to acoustic energy in the open air of said sound field;

mounting each body in the open air of the sound field so that the active outer surface in the open air is in free and movable contact with the open air of the sound field and additionally the active outer surface is free and movable for absorption of acoustic energy from the open air of said sound field whereby said body absorbs acoustic energy in use from the open air of said sound field; and providing each body with a closed volume having a gas pressure and in which each body is movable in use at least by movement of said active outer surface between states where the volume is one of a) inflated and collapsed or b) extended and compressed, by a variation in a gas pressure therein, in order to change one of an absorption coefficient α or a resonance frequency of said body between a very high value and a very low value substantially lower than the very high value; and actively varying the gas pressure of each of the closed volumes of said bodies in the open air of the sound field, to thereby vary the at least one of the absorption coefficient α or the resonance frequency of said body-bodies between the very high and very low values.

16. A method according to claim 15, further including the step of choosing the acoustic resistance of the active outer surfaces of said bodies that are in contact with said the open air of said sound field such that a substantial impedance match exists between the active outer surfaces and the open air in the sound field.

17. A method according to claim 15, where the resonance frequency $f_o$, acoustic resistance ratio μ, maximum absorption coefficient $\alpha_{max}$ and absorption bandwidth $B_r$ are given by $$f_0 = \frac{c}{2\pi}\sqrt{\frac{\rho}{md}} \tag{1}$$

$$\mu = \frac{r_i}{r_s} \tag{2}$$

$$\alpha_{max} = \frac{4\mu}{(1+\mu)^2} \tag{3}$$

-continued $$\frac{B_r}{f_0} = (1+\mu)\sqrt{\frac{\rho d}{m}}. \tag{4}$$

18. A method for reducing the reverberation time of a room at least in a low-frequency region from a given reverberation time $T_{60}$ to a desired reverberation time $T_{60,S}$ comprising the steps of:

introducing into the room a sound-absorbing device which is placed in a sound field in air for absorbing acoustic energy from said sound field at least in a predetermined low-frequency region, the device including a body containing one or more cavities, said body including an outer surface with at least a portion thereof in contact with said sound field, and being movable between states where the cavities are one of a) inflated and collapsed or b) extended and compressed, by a variation in a gas pressure therein, and actively varying the gas pressure in said one or more cavities in order to actively vary at least one of the absorption coefficient α or the resonance frequency of said body; and when variation of the gas pressure is no longer desired, winding up, on a structure provided with a roller, said sound absorbing device with a drive mechanism.

19. A method according to claim 18, where a required total surface area $S_s$ of said body of said device is determined by the equation $$\alpha = \frac{55.3V}{cS_S}\left(\frac{1}{T_{60}^S} - \frac{1}{T_{60}}\right) \tag{5}$$

where α is the absorption coefficient of the absorbing device, V is the volume of the room and c is the speed of sound.

20. A method according to claim 18, where said reduction of reverberation time predominantly takes place in a low-frequency region determined by a resonance frequency and absorption bandwidth determined where the resonance frequency $f_o$, acoustic resistance ratio μ, maximum absorption coefficient $\alpha_{max}$ and absorption bandwidth $B_r$ are given by $$f_0 = \frac{c}{2\pi}\sqrt{\frac{\rho}{md}} \tag{1}$$

$$\mu = \frac{r_i}{r_s} \tag{2}$$

$$\alpha_{max} = \frac{4\mu}{(1+\mu)^2} \tag{3}$$

$$\frac{B_r}{f_0} = (1+\mu)\sqrt{\frac{\rho d}{m}}. \tag{4}$$

21. A system for reducing the reverberation time of a room comprising:

a plurality of sound-absorbing assemblies, each sound-absorbing assembly including at least one sound-absorbing device which is placed in a sound field in air for absorbing acoustic energy from said sound field at least in a predetermined low-frequency region, comprising a body containing one or more cavities, said body including an outer surface with at least a portion thereof in contact with said sound field, and being movable between states where the cavities are one of a) inflated and collapsed or b) extended and compressed, by a variation in a gas pressure therein, and a means for actively varying the gas pressure in said one or more cavities in order to actively vary at least one of the absorption coefficient $\alpha$ or the resonance frequency of said body;

a structure provided with a roller upon which said at least one sound absorbing device can be wound and a drive mechanism for rotating said roller; and conduits through which the gas pressure can be supplied via a source to each of said assemblies and removed therefrom.

22. A system according to claim 21, wherein said assemblies are provided with valve means for controlling the gas pressure in said assemblies.

23. A system according to claim 22, wherein said valve means are remote controllable, and further including a central control device for controlling the gas pressure of said assemblies.

24. A system according to claim 21, further comprising means for measuring the reverberation time of the room.

25. A system according to claim 21, further comprising data storage means for storing measured reverberation times and corresponding parameters of the assemblies.

26. Sound-absorbing system which is placed in a sound field of a room for absorbing acoustic energy from open air in the room at least in a predetermined low-frequency region, said system comprising:

a series of sound absorbing devices having first and second sides; and a mounting means for mounting said series of said sound absorbing devices with at least one of said first and second sides having free and movable contact to the open air in the room; and wherein each said sound absorbing device includes a body containing one or more cavities, each said cavity i) including first and second opposed surfaces with one of said opposed surfaces forming in use the one of the first and second sides having the free and movable contact with the open air of the room and additionally being free and movable for absorption of acoustic energy from the open air of the room, and ii) having a volume which is movable in use at least by movement of said active outer surface in the open air of the room between states where the volume is one of a) inflated and collapsed or b) extended and compressed, by a variation in a gas pressure therein, in order to change one of an absorption coefficient $\alpha$ or a resonance frequency of said body between a very high value and a very low value substantially lower than the very high value; and a pressure means for actively varying the gas pressure in said cavities of said series of said sound absorbing devices in use in order to actively vary at least one of the absorption coefficient $\alpha$ or the resonance frequency of said bodies between the very high value and the very low value substantially lower than the very high value.

27. Sound-absorbing system according to claim 26, where said low-frequency region has an upper frequency limit of approximately 200 Hz.

28. Sound-absorbing system according to claim 26, where said low-frequency region is 50 Hz to 125 Hz.

29. Sound-absorbing system according to claim 26, where a material of said body is chosen such that there exists a substantial impedance match between the body and the surrounding open air of the room field, at least in said low-frequency region.

30. Sound-absorbing system according to claim 26, where at least one of said one or more cavities is provided with sound-absorbing material within said cavity.

31. Sound-absorbing system according to claim 26, wherein said pressure means varies the gas pressure in at least two of said cavities separately from each other.

* * * * *